United States Patent [19]

Shea, Sr.

[11] Patent Number: 5,036,923

[45] Date of Patent: Aug. 6, 1991

[54] FIRE SPRINKLER WITH ADJUSTABLE DEFLECTOR

[75] Inventor: Raymond E. Shea, Sr., Holden, Mass.

[73] Assignee: U.S. Fire Control Corporation, Rochdale, Mass.

[21] Appl. No.: 560,419

[22] Filed: Jul. 30, 1990

[51] Int. Cl.[5] ..... A62C 37/09

[52] U.S. Cl. ..... 169/37; 169/41

[58] Field of Search ..... 169/37, 41; 239/448, 239/500, 513

[56] References Cited

U.S. PATENT DOCUMENTS

| | | | |
|---|---|---|---|
| 3,802,512 | 4/1974 | Todtenkopf | 169/37 |
| 4,091,873 | 5/1978 | Werner | 169/37 |
| 4,405,018 | 9/1983 | Fischer | 169/37 |
| 4,465,141 | 8/1984 | Johnson | 169/37 |
| 4,491,182 | 1/1985 | Pieczykolan | 169/38 |

*Primary Examiner*—Joseph F. Peters, Jr.
*Assistant Examiner*—Linda L. Palomar
*Attorney, Agent, or Firm*—John E. Toupal; Harold G. Jarcho

[57] ABSTRACT

A fire sprinkler including a body defining an inlet adapted for connection to a supply of fire extinguishing fluid and an outlet adapted for placement in a zone to be sprinkled; a valve retained by the body and movable between a closed position providing a fluid tight seal between the inlet and the outlet and an open position allowing fluid flow therebetween; an actuator for moving the valve from the closed position to the open position in response to a predetermined condition; and a deflector disposed to disperse into the zone fluid discharged from the outlet; the deflector comprising a plurality of deflector elements each adapted to deflect fluid discharged from the outlet. Also included is a coupling between the deflector elements and adapted to permit adjustment in the relative positions of the deflector elements so as to selectively change the pattern in which fluid discharged from the outlet is dispersed into the zone. Selective adjustment of the deflector elements provides dispersion patterns that conform to particular portions of the zone.

21 Claims, 2 Drawing Sheets

FIRE SPRINKLER WITH ADJUSTABLE DEFLECTOR

BACKGROUND OF THE INVENTION

This invention relates generally to fire sprinklers, and more particularly, to a fire sprinkler having an adjustable deflector for providing variable fluid discharge distribution patterns.

Sprinkler heads of various configuration are widely used in fire protection systems. Typically, each sprinkler head includes a deflector disposed to disperse in a predetermined pattern the extinguishing fluid emanating from a discharge orifice. By establishing extinguishing fluid distribution throughout a fire protected zone, effective fire control can be obtained.

In the interest of efficient extinguishing fluid use, it is highly desirable that the discharge fluid be uniformly distributed throughout the protected zone. Such uniform distribution is obtained by strategically positioning sprinkler heads each having a preselected deflector that establishes a dispersion pattern conforming to a particular portion of the protected zone. Although enhancing extinguishing fluid use efficiency, installation and inventory problems are created by the utilization of a variety of differently shaped deflectors each providing a unique fluid distribution pattern.

The object of this invention, therefore, is to provide an improved fire sprinkler having an adjustable deflector of providing variable fluid distribution patterns.

SUMMARY OF THE INVENTION

The invention is a fire sprinkler including a body defining an inlet adapted for connection to a supply of fire extinguishing fluid and an outlet adapted for placement in a zone to be sprinkled; a valve retained by the body and movable between a closed position providing a fluid tight seal between the inlet and the outlet and an open position allowing fluid flow therebetween; an actuator for moving the valve from the closed position to the open position in response to a predetermined condition; and a deflector disposed to disperse into the zone fluid discharged from the outlet; the deflector comprising a plurality of deflector elements each adapted to deflect fluid discharged from the outlet. Also included is a coupling between the deflector elements and adapted to permit adjustment in the relative positions of the deflector elements so as to selectively change the pattern in which fluid discharged from the outlet is dispersed into the zone. Selective adjustment of the deflector elements provides dispersion patterns that conform to particular portions of the zone.

According to one feature of the invention, each of the deflector elements comprises a deflection portion adapted to deflect the discharged fluid, the deflection portions are juxtaposed to provide together a deflection surface for deflecting the discharged fluid, and the coupling permits relative movement between the deflection portions so as to selectively alter the geometry of the deflection surface. Altering the geometry of the deflection portions establishes desired dispersion patterns.

According to other features of the invention, each of the deflection portions comprises a peripheral portion of its deflector element, each of the deflector elements comprises a substantially planar surface defining the peripheral portion, the planar surfaces are juxtaposed and substantially parallel to each other and substantially transverse to the discharge from the outlet, and the coupling permits relative angular movement between the planar surfaces. This arrangement facilitates adjustment of the deflector geometry.

According to yet other features of the invention, the peripheral portions comprise an annular portion terminating the planar surface, each of the annular portions defines a plurality of spaced apart slots, the slots of one of the annular portions being juxtaposed to the slots in the other annular portion, and the coupling permits adjustment in the degree of coincidence between the slots. Adjustment in the degree of coincidence between the slots permits establishment of a desired fluid dispersion pattern.

According to still another feature of the invention, each element comprises a circular disc having an outer periphery defining the slots, and the discs are juxtaposed and substantially parallel to each other. The slotted discs efficiently provide the fluid dispersion pattern adjustability.

According to a further feature of the invention, the coupling is adjustable between a locked position that prevents relative movement between the deflection portions and a released position that permits relative movement therebetween. After desired adjustment of the deflector elements, their relative positions are fixed by the coupling.

According to an additional feature of the invention, the sprinkler includes a connector securing the deflector elements to the body and adapted in response to the predetermined condition to permit movement of the deflector elements from an inactive position closely adjacent to the outlet to an active position substantially spaced therefrom. This feature permits use of the deflector elements with a recessed sprinkler.

According to yet further features of the invention, the actuator comprises a sensor for sensing the predetermined condition, the coupling comprises an annular member having outer threads engaging the deflector elements, and the sensor extends through the annular member. This arrangement facilitates use of the adjustable deflector elements with a recessed sprinkler.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
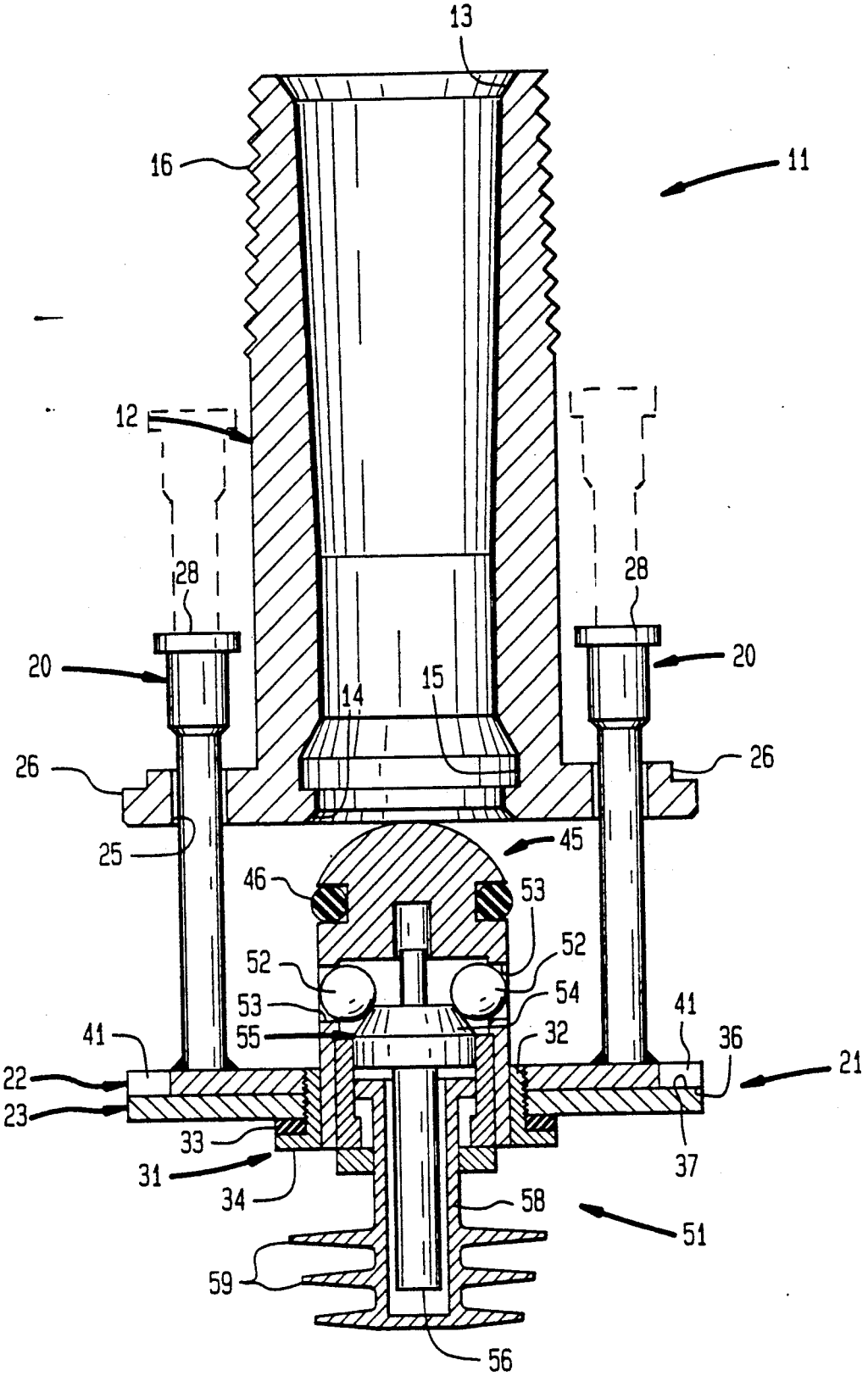
FIG. 1 is a cross sectional view of a fire sprinkler according to the invention.

A fire sprinkler 11 has a cylindrical body 12 defining at opposite ends an inlet 13 and an outlet 14. Formed in an inner wall of the cylindrical body 12 is an annular recess 15 disposed adjacent to the outlet 14. An externally threaded portion 16 of the body 12 adjacent to the inlet 13 is adapted for connection to a suitable source of fire extinguishing fluid such as water or liquid chemicals.

A deflector assembly 21 is attached to the body 12 by a pair of connector struts 20. Included in the deflector assembly 21 is an upper deflector disc element 22 and a lower deflector disc element 23. One end of each of the struts 20 is attached, for example, by welds to the upper disc 22 while an opposite end extends through openings 25 in an outwardly projecting annular flange portion 26 of the body 12. The struts 20 accommodate movement of the deflector assembly 21 between an inactive position shown by dashed lines in FIG. 1 and an active position shown by solid lines therein. Establishing the active position of the deflector assembly 21 are head portions 28 of the struts 24 that engage an upper surface of the flange portion 26. The upper and lower deflector discs 22, 23 are attached by a coupling nut 31. An externally threaded shank portion 32 of the nut 31 engages threaded central openings in the upper and lower discs 22, 23. Retained between the lower surface of the lower disc 23 and an outwardly extending skirt portion 34 of the nut 31 is a resilient washer 33.

As shown in FIG. 1, the upper and lower deflector discs 22, 23 extend transversely to the discharge provided by the outlet 14 and include, respectively, engaged planar surfaces 36, 37. Formed in an outer, circular peripheral portion of the upper disc 22 are a plurality of circumferentially spaced apart slots 41. Similarly, formed in an outer, circular peripheral portion of the lower disc 23 are a plurality of circumferentially spaced apart slots 42. The upper and lower slot arrays 41, 42 are coaxial with the outlet 14 of the body 12 and are equally radially spaced from the centers of the discs 22, 23.

Supported by for movement with the deflector assembly 21 is a valve body 45 having an annular slot that retains an O-ring 46. With the deflector assembly 21 in its inactive position, the O-ring 46 establishes a fluid tight seal against the inner wall of the cylindrical body 12 preventing fluid flow between the inlet 13 and the outlet 14. The valve 45 projects out of the cylindrical body 12 with the deflector assembly 21 in its active position so as to allow fluid flow between the inlet 13 and the outlet 14 as shown in FIG. 1.

An actuator assembly 51 is supported by a lower portion of the valve body 45 and extends through the cylindrical coupling nut 31 of the deflector assembly 21. Included in the actuator assembly 51 are a plurality of locking balls 52 that project through radial openings 53 in the valve body 45 into the annular recess 15 of the cylindrical body 12 with the deflector assembly 21 in its inactive position. Normally retaining the balls 52 within the recess 15 is a tapered annular surface 54 of an actuator element 55 having a downwardly extending shaft portion 56. Enclosing the shaft portion 56 is an elongated cylindrical well 58 having at its bottom end outwardly projecting circular ribs 59 that function as heat sinks.

With the deflector assembly 21 in its inactive position, a volume of eutectic sensor material (not shown) in the bottom of the cylindrical well 58 retains the actuator element 55 in an upper position that locks the balls 52 in the annular recess 15 of the body 12 to prevent movement of the valve 45. However, at a predetermined environmental temperature, the eutectic sensor material melts allowing the actuator 55 to move downwardly into the position shown in FIG. 1, thereby releasing the balls 52 and allowing the fluid pressure in the body 12 to move the valve 45 and deflector assembly 21 into the active positions shown in FIG. 1. A more complete description of the operation of the actuator assembly 51 appears in U.S. Pat. No. 4,465,141.

Figure 6:
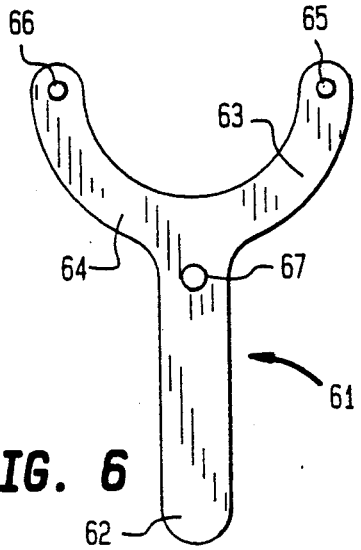
FIG. 6 is a plan view of a tool for adjusting the deflector assembly shown in FIG. 1.
Figure 7:
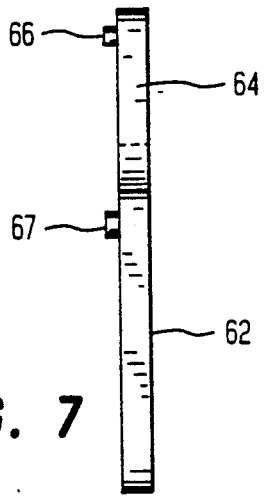
FIG. 7 is a side view of the tool shown in FIG. 6.

With the sprinkler 11 in the active position shown in FIG. 1, extinguishing fluid discharged through the outlet 14 is dispersed by the outer peripheral portions of the upper and lower deflector discs 22, 23. The particular fluid dispersion pattern produced by the deflector assembly 21 can be selectively varied by adjusting the degree of coincidence existing between the slots 41 and the upper disc 22 and the slots 42 in the lower disc 23. Adjustment is accomplished by employing a tool 61 shown in FIGS. 6 and 7. Normally, the nut 31 is inserted tightly into the threaded openings in the upper and lower discs 22, 23 creating forces that prevent relative annular movement therebetween. However, after retracting the nut 31 to reduce the forces applied between the discs 22, 23, the tool 61 can be used to produce relative angular movement therebetween and thereby establish a desired degree of coincidence between the slots 41 and 42.

The tool 61 includes a handle portion 62 extending from bifurcated arms 63, 64. Projecting outwardly from the outer ends of each of the arms 63, 64, respectively, is a nipple 65, 66. A similar nipple 67 projects outwardly from the end of the handle 62 directly adjacent to the bifurcated arms 63, 64. After insertion of the nipple 67 into one of the slots 42 and the nipples 65, 66 into suitably aligned holes 70 in the lower disc 23, the handle 62 can be rotated to induce angular movement of the lower disc 23 with respect to the upper disc 22. In that way, one can obtain any of a wide variety of fluid dispersion patterns each associated with a predetermined degree of coincidence between the upper and lower slots 41, 42.

Figure 2:
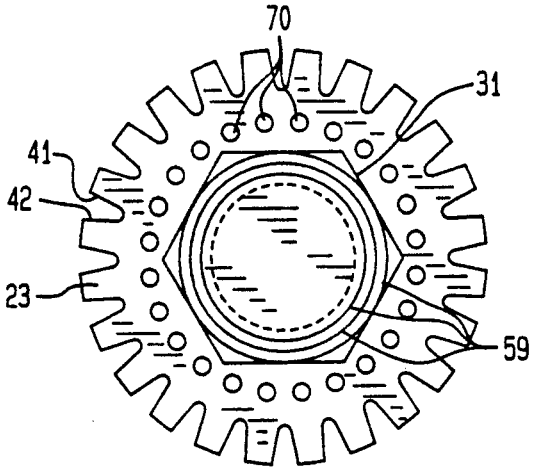
FIG. 2 is a bottom view of the fire sprinkler shown in FIG. 1 with a deflector assembly in a first configuration.
Figure 3:
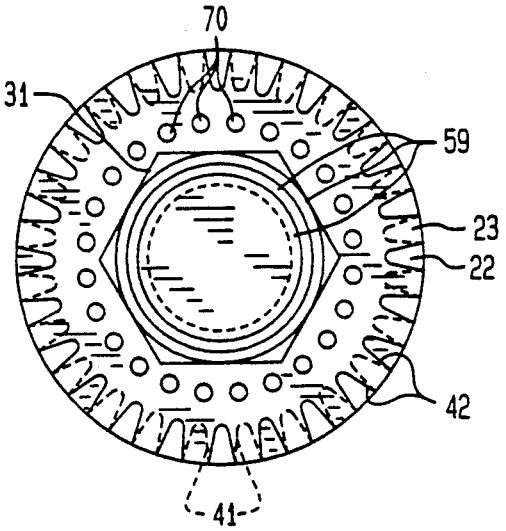
FIG. 3 is a bottom view of the fire sprinkler shown in FIG. 1 with the deflector assembly in a second configuration.
Figure 4:
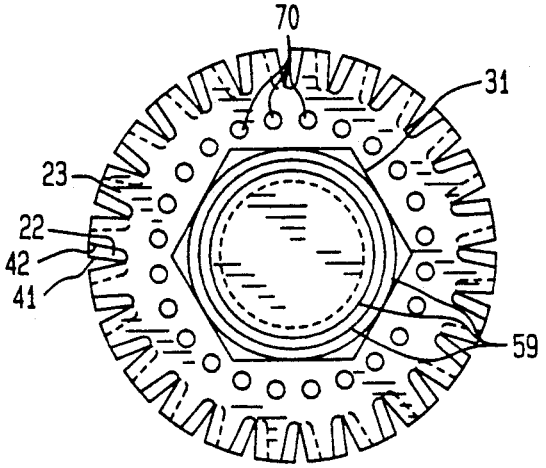
FIG. 4 is a bottom view of the fire sprinkler shown in FIG. 1 with the deflector assembly in a third configuration.
Figure 5:
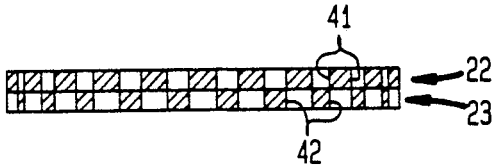
FIG. 5 is a semi-circular cross sectional view taken through the periphery of the deflector assembly shown in FIG. 1.

As shown in FIG. 2, for example, the relative angular positions of the upper and lower discs 22, 23 are adjusted to produce exact alignment between the upper and lower slots 41, 42. Conversely, as shown in FIG. 3 the relative angular positions of the upper and lower discs 22, 23 are adjusted to produce full non-alignment of the upper and lower slots 41, 42 thereby completely closing the outer periphery of the deflector assembly 21. By establishing any of a variety of relative angular positions intermediate to those shown in FIGS. 2 and 4, one can establish a variety of different degrees of coincidence between the slots 41, 42, each providing a different fluid dispersion pattern. One such intermediate position is shown in FIG. 4.

Obviously, many modifications and variations of the present invention are possible in light of the above teachings. It is to be understood, therefore, that the invention can be practiced otherwise than as specifically described.

What is claimed is:

1. A fire sprinkler comprising:

body means defining an inlet adapted for connection to a supply of fire extinguishing fluid and an outlet adapted for placement in a zone to be sprinkled;

valve means retained by said body means and movable between a closed position providing a fluid tight seal between said inlet and said outlet and an open position allowing fluid flow therebetween;

actuator means for moving said valve means from said closed position to said open position in response to a predetermined condition;

deflector means disposed to disperse into the zone fluid discharged from said outlet; said deflector means comprising a plurality of deflector elements each adapted to deflect fluid discharged from said outlet, each of said deflector elements comprises a deflection portion adapted to deflect said discharged fluid, and said deflection portions are closely juxtaposed to provide together a single deflection surface means for unitarily deflecting said discharged fluid; and coupling means between said deflector elements and adapted to permit adjustment in the relative positions of said deflector elements so as to selectively change the pattern in which fluid discharged from said outlet is dispersed into said zone, said coupling means permitting relative movement between said deflection portions so as to selectively alter the geometry of said deflection surface means.

2. A sprinkler according to claim 1 wherein each of said deflection portions comprises a peripheral portion of its deflector element.

3. A sprinkler according to claim 2 wherein each of said deflector elements comprises a substantially planar surface defining said peripheral portion, said planar surfaces are juxtaposed and substantially parallel to each other and substantially transverse to the discharge from said outlet, and said coupling means permits relative angular movement between said planar surfaces.

4. A sprinkler according to claim 3 wherein each of said peripheral portions comprises an annular portion terminating said planar surface.

5. A sprinkler according to claim 4 wherein each of said annular portions defines a plurality of spaced apart slots, said slots of one of said annular portions being juxtaposed to said slots in said other annular portion, and said coupling means permits adjustment of the degree of coincidence between said slots.

6. A sprinkler according to claim 5 wherein each of said elements comprises a disc having an outer periphery defining said slots, and said discs are juxtaposed and substantially parallel to each other.

7. A sprinkler according to claim 6 wherein said outer peripheries are substantially circular.

8. A sprinkler according to claim 5 including connector means securing said deflector elements to said body means and adapted in response to said predetermined condition to permit movement of said deflector elements from an inactive position closely adjacent to said outlet to an active position substantially spaced therefrom.

9. A sprinkler according to claim 8 wherein said outlet is substantially coaxially aligned with said annular portions.

10. A sprinkler according to claim 9 wherein said acutator means extends through central portions of said deflector elements so as to be at least partially disposed on sides thereof opposite to said body means.

11. A sprinkler according to claim 10 wherein each of said elements comprises a disc having an outer periphery defining said slots, and said discs are juxtaposed and substantially parallel to each other.

12. A sprinkler according to claim 11 wherein said outer peripheries are substantially circular.

13. A sprinkler according to claim 12 wherein said coupling means is adjustable between a locked position that prevents said relative movement between said deflection portions and a released position that permits said relative movement.

14. A sprinkler according to claim 13 wherein said planar surfaces are engaged, and said coupling means exerts in said locked position a force between said planar surfaces that prevents said relative movement and in said released position a reduced force therebetween that permits said relative movement.

15. A sprinkler according to claim 14 wherein said coupling means comprises a threaded member threadedly engaging said deflector elements.

16. A sprinkler according to claim 15 wherein said threaded member is an annular member having outer threads engaging said deflector elements, and said sensing means extends through said annular member.

17. A sprinkler according to claim 1 wherein said coupling means is adjustable between a locked position that prevents said relative movement between said deflection portions and a released position that permits said relative movement.

18. A sprinkler according to claim 17 wherein each of said deflection portions comprises a peripheral portion of its deflector element.

19. A sprinkler according to claim 18 wherein each of said deflector elements comprises a substantially planar surface defining said peripheral portion, said planar surfaces are juxtaposed and substantially parallel to each other and substantially transverse to the discharge from said outlet, and said coupling means permits relative angular movement between said planar surfaces.

20. A sprinkler according to claim 19 wherein said planar surfaces are engaged, and said coupling means exerts in said locked position a force between said planar surfaces that prevents said relative movement and in said released portion a reduced force therebetween that permits said relative movement.

21. A sprinkler according to claim 20 wherein said coupling means comprises a threaded member threadedly engaging said deflector elements.

* * * * *